US005425538A

United States Patent [19]

Vincent et al.

[11] Patent Number: 5,425,538

[45] Date of Patent: Jun. 20, 1995

[54] GOLF CLUB HEAD HAVING A FIBER-BASED COMPOSITE IMPACT WALL

[75] Inventors: Benoît Vincent, Annecy le Vieux; François Viollaz, Evian, both of France

[73] Assignee: Taylor Made Golf Company, Inc., Carlsbad, Calif.

[21] Appl. No.: 170,180

[22] PCT Filed: Nov. 4, 1991

[86] PCT No.: PCT/FR91/00859

§ 371 Date: Dec. 30, 1993

§ 102(e) Date: Dec. 30, 1993

[87] PCT Pub. No.: WO93/00968

PCT Pub. Date: Jan. 21, 1993

[30] Foreign Application Priority Data

Jul. 11, 1991 [FR] France ..... 91 09001

[51] Int. Cl.[6] ..... A63B 53/04

[52] U.S. Cl. ..... 273/167 H; 273/78; 273/167 J; 273/173

[58] Field of Search ..... 273/167 R, 167 D, 167 H, 273/167 J, 173, 175, 78

[56] References Cited

U.S. PATENT DOCUMENTS

| | | | |
|---|---|---|---|
| 1,359,220 | 11/1920 | Beamer . | |
| 3,218,072 | 11/1965 | Burr | 273/78 |
| 3,390,881 | 7/1968 | Senne | 273/173 |
| 3,567,228 | 3/1971 | Lynn | 273/173 X |
| 3,695,618 | 10/1972 | Woolley et al. | 273/173 |
| 3,975,023 | 8/1976 | Inamori | 273/173 |
| 4,021,047 | 5/1977 | Mader | 273/167 H |
| 4,123,060 | 10/1978 | Sterling | 273/167 R |
| 4,252,262 | 2/1981 | Igarashi | 273/174 |
| 4,398,965 | 8/1983 | Campau | 273/78 X |
| 4,429,879 | 2/1984 | Schmidt | 273/167 H |
| 4,438,931 | 3/1984 | Motomiya | 273/167 H |
| 4,534,558 | 8/1985 | Yoneyama | 273/78 |
| 4,582,321 | 4/1986 | Yoneyama | 273/78 |
| 4,630,826 | 12/1986 | Nishigaki et al. | 273/167 H |
| 4,766,698 | 8/1988 | Solomko | 273/167 R X |
| 4,792,139 | 12/1988 | Nagasaki et al. | 273/167 H |
| 4,798,383 | 1/1989 | Nagasaki et al. | 273/167 H |
| 4,804,188 | 2/1989 | McKee et al. | 273/167 R |
| 4,884,812 | 12/1989 | Nagasaki et al. | 273/167 H |
| 5,024,437 | 6/1991 | Anderson | 273/78 |
| 5,094,383 | 3/1992 | Anderson et al. | 228/176 |
| 5,255,913 | 10/1993 | Tsuchida | 273/78 |

FOREIGN PATENT DOCUMENTS

| | | |
|---|---|---|
| 211781 | 1/1957 | Australia . |
| 0317711 | 5/1989 | European Pat. Off. . |
| 1259876 | 10/1989 | Japan . |
| 25979 | 1/1990 | Japan . |
| 2191475 | 7/1990 | Japan . |
| 243435 | 11/1925 | United Kingdom . |
| 1227948 | 4/1971 | United Kingdom . |
| 2132902 | 7/1984 | United Kingdom . |
| 2162431 | 2/1986 | United Kingdom . |
| 2173407 | 10/1986 | United Kingdom . |
| 2208356 | 3/1989 | United Kingdom . |
| 9222356 | 12/1992 | WIPO . |

OTHER PUBLICATIONS

*Golfsmith* 1993 Catalog, p. 37, describing the "Xtra" oversized graphite wood heads, and p. 46, describing the Tour Tech graphite insert metal wood head.

Patent Abstracts of Japan, vol. 14, No. 131 (C-700) (4074), Mar. 13, 1990.

Maltby, R. *Golf Club Design, Fitting, Alteration and Repair,* Chapter 3, four pages, including Figs. 3-1 to 3-6 and Figs. 3-25 to 3-33, 1986.

"What Irons are Best for You—Forged or Cast," Dennis, Larry, *Golf Digest,* vol. 26, No. 1, Jan. 1975, pp. 40, 41.

"Fire Up Your Game With The New Thunder Heat Driver," Spalding Professional Golf advertisement GC-032, Jan. 1992.

French Search Report and Annex.

*Primary Examiner*—William H. Grieb

*Attorney, Agent, or Firm*—Sandler, Greenblum & Bernstein

[57] ABSTRACT

A golf club head including an outside lower portion intended to rest on the ground, constituting the sole, a substantially plane front portion constituting the impact surface, and a rear portion constituting the body, wherein the club head includes an internal cavity limited at least partially by the walls of a steel shell in the lower and rear portion, and that at least the impact surface is a fiber-based composite material of which the modulus of the elasticity is greater than or equal 230 GPa.

15 Claims, 6 Drawing Sheets

GOLF CLUB HEAD HAVING A FIBER-BASED COMPOSITE IMPACT WALL

BACKGROUND OF THE INVENTION

1. Field of the Invention

The present invention relates to a golf club head, and more specifically, a "wood" type head.

2. Discussion of Background and Relevant Information

Currently, the clubs used by golfers when striking the ball from the "tee" or starting zone to propel the ball over long distances are known as "woods". Originally, "woods" were constructed entirely of wood materials such as persimmon or other varieties. These clubs are still appreciated by many players, but they are not very tolerant, given the low density of the material utilized and its homogeneous distribution behind the impact surface of the club head.

The "wood-metal" club appeared in order to alleviate this disadvantage by keeping the form of the wood, but with a head constructed entirely of steel. Given the high density of the material utilized and the mass constraints imposed, the wood-metal generally comprises a hollow steel head, generally obtained by cire perdue casting/lost wax process. In this type of construction, the mass is mainly distributed at the periphery of the impact surface, and imparts the club with a tolerance that is significantly greater than that of the conventional "woods". This tolerance concerns both the starting angle of the ball, also known as "loft" angle defining the vertical trajectory of the ball, as well as the deviation of the ball, i.e., the lateral trajectory of the ball.

A first disadvantage of the wood-metals concerns the unpleasant sensations felt by the players during impact, due to the metallic contact with the surface on the ball.

Another disadvantage arises from the fact that the stiffness of the steel impact surface, the thickness of which must be sufficient to support the shock of a hit, is not optimum. It can be demonstrated that a decrease in the rigidity of the surface increases the speed of restitution, thus generating a greater flight distance. Therefore, one can demonstrate that the rigidity of the surface depends upon the thickness of the impact surface and the modulus of elasticity of the material. At a given modulus of elasticity, the decrease in rigidity is thus directly related to a decrease in the thickness of the surface. Therefore, it presently appears that the optimum point of rigidity of the impact surface of a "wood-metal" corresponds to a thickness that is too low, at less than 3 mm, bringing about its irreversible deformation.

SUMMARY OF THE INVENTION

Therefore, the object of the present invention consists of proposing a new golf club head construction, especially the "wood" type, providing the player with good sensations during impact, and enabling good operation of the ball. Another goal is to propose a head with a tolerance that is identical to that of a current construction of a club of the same type, especially the wood-metal, but whose stiffness can be chosen in an optimum fashion, thus simultaneously enabling an increase in the contact time of the ball on the impact surface as well as the starting speed and sensation of control over the ball.

To this end, the present invention provides for a golf club head comprising an outside lower portion intended to rest on the ground, constituting the sole, a substantially planar front portion constituting the impact surface, and a rear portion constituting the body itself, wherein the club head includes a closed internal cavity, limited at least partially by the walls of a steel shell in the lower and rear portions, and that the impact surface is obtained, at least in the impact zone of the ball, from a fiber-based composite material of which the modulus of elasticity is greater than or equal to 230 GPa.

Advantageously, the composite material is constituted of carbon and/or aramide fibers impregnated with a thermoplastic or thermohardenable resin. Due to the substantial resistance properties of these fibers, the specific choice of these materials in constructing the surface especially enables an optimum decrease in the stiffness of the impact surface, while preserving a sufficient thickness comparable to that of a conventional steel surface.

The presence of a steel shell has the effect of maintaining a sufficient mass in the golf club head and, distributed at the periphery of the head, it thus increases the tolerance of the club.

This tolerance can be optimized in such a construction, and it can be provided that the shell comprises an excessive thickness of material forming an additional mass of inertia in the region near and behind the periphery of the impact surface. This mass especially can extend homogeneously and continuously along the entire region behind the periphery of the surface, thus imparting a tolerance in the vertical and horizontal trajectory of the ball.

BRIEF DESCRIPTION OF THE DRAWINGS

The above and additional objects, characteristics, and advantages of the present invention will become apparent in the following detailed description of preferred embodiments, with reference to the accompanying drawings which are an integral part of this description and which are presented as non-limiting examples, in which.

Figure 6:
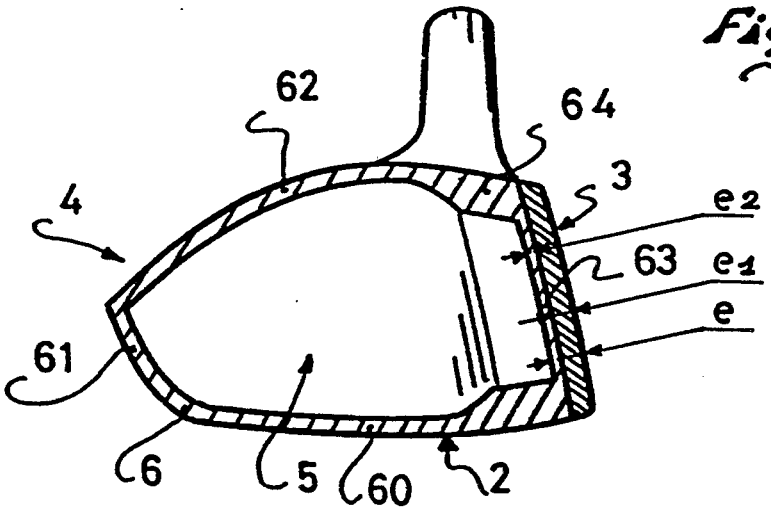
FIG. 6 is a variation of FIG. 4.

FIGS, 15 and 16 are other variations of FIG. 6.

DETAILED DESCRIPTION OF PREFERRED EMBODIMENTS

Figure 1:
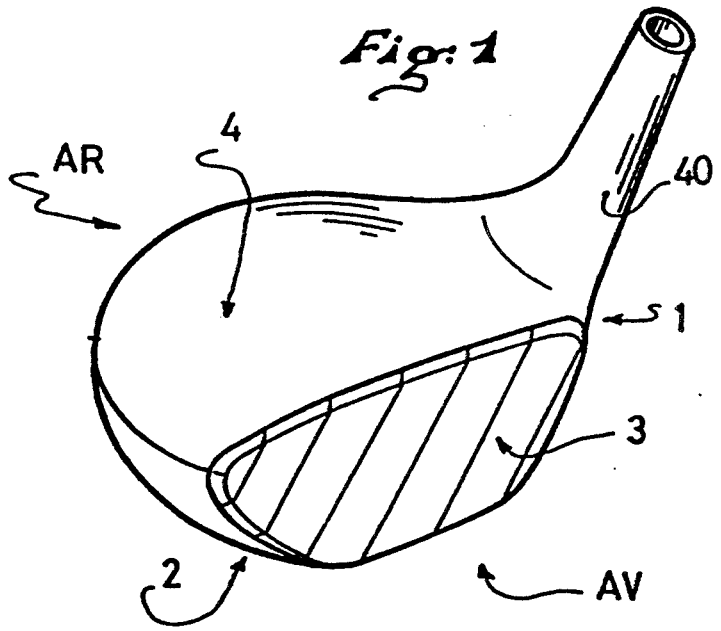
FIG. 1 is a perspective view of a club head according to the invention.
Figure 2:
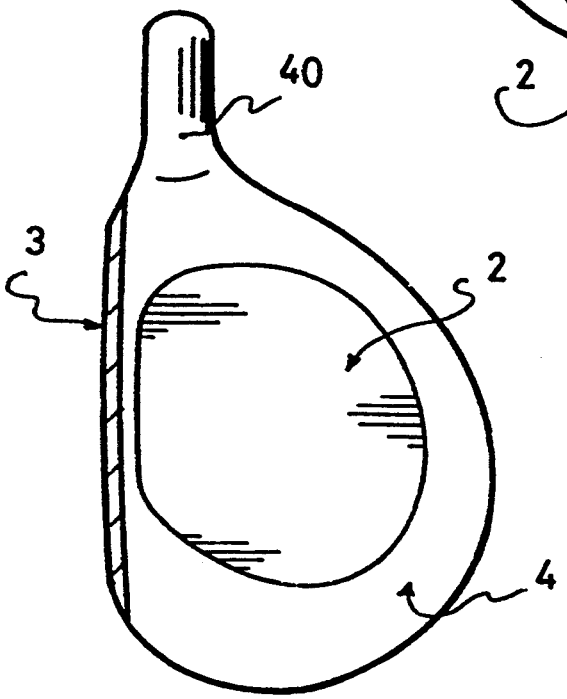
FIG. 2 is a bottom plan view of the head of FIG. 1.
Figure 3:
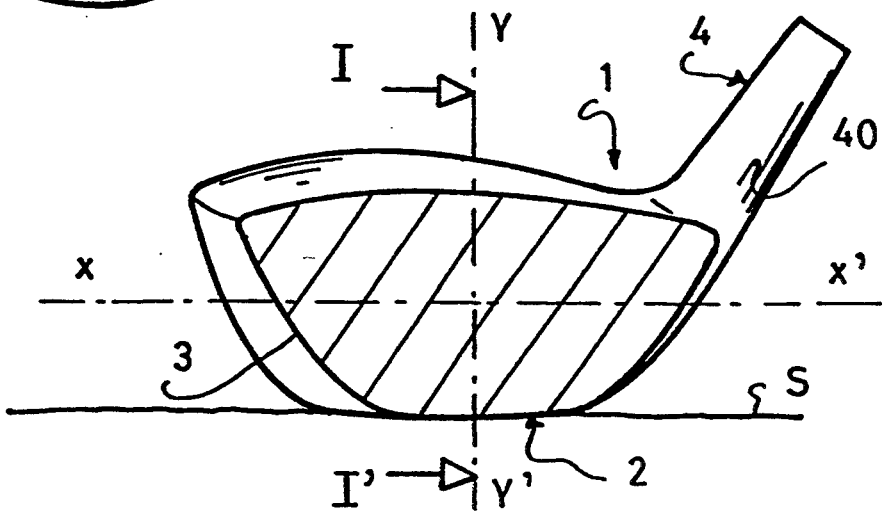
FIG. 3 is a front elevation view of the head according to FIGS. 1 or 2.

The club head according to the invention, as shown in FIGS. 1–3 representing a "wood" type head 1, includes a substantially planar front portion AV constituting the impact surface 3, a rear portion AR constituting the body 4 itself, and a lower portion intended to rest on the ground S, constituting the sole 2. The body 4 extends along the side via a neck 40, which is integral to the body 4.

Figure 4:
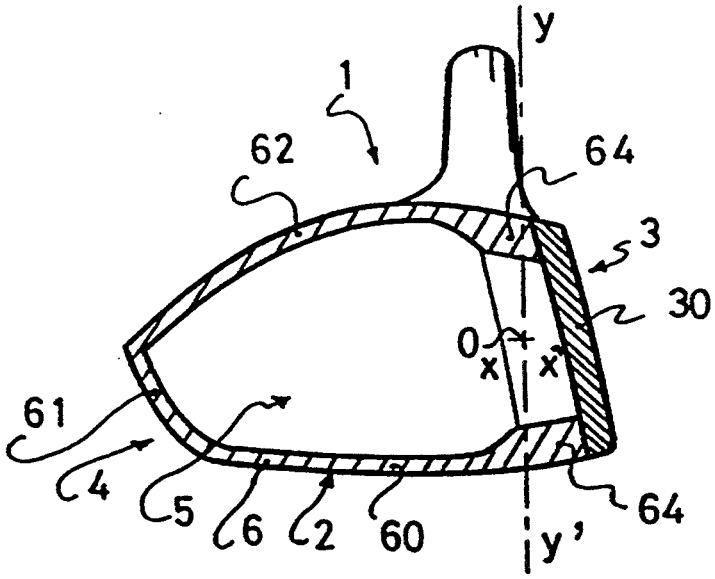
FIG. 4 is a transverse sectional view taken along I—I' of FIG. 3.

In the embodiment of FIG. 4, a closed internal cavity 5 is arranged in the head 1. It is limited on the one hand, by the lower wall 60, the rear wall 61, and the upper wall 62 of a shell 6 made of a highly dense material, especially steel, and on the other hand, by the wall 30 of the impact surface 3. In this case, the wall 30 is made entirely from a composite material. The assembly can be obtained especially by adhesion, screws, or any other means.

The expression "composite material" is intended to encompass woven webs of carbon and/or aramide fibers impregnated with a thermoplastic or thermohardenable resin material. Among the preferred fibers are long carbon fibers of high mechanical resistance whose modulus of elasticity can vary from 230 to 590 GPa, and whose tear strength can vary from 2450 to 7000 MPa. Of course, such values are higher than those of known conventional steels. The matrices or resins can be of a polyphenylene sulfide (PPS), polyether imide (PEI), polyether-ether-ketone (PEEK), or epoxyde type.

Advantageously, the shell 6 comprises an excessive thickness of material 64 constituting an additional mass of inertia positioned in a region near and behind the periphery of the impact surface 3. This excessive thickness 64 extends substantially along the entire such region, such that the mass is distributed as far as possible on either side of the horizontal axis of symmetry (x,x') and the vertical axis of symmetry (y,y'). These axes are perpendicular to one another, and pass through the center of gravity O of the head 1. The axis (x,x') is parallel to the impact surface on the one hand, and to the ground on the other hand, when the head rests on the sole 2, and the rotation of the head with respect to this axis defines the "loft" angle which directly influences the starting angle of the trajectory of the ball. Consequently, the distribution of an additional mass of inertia on either side of the center of gravity O on this axis directly influences the tolerance of the club with respect to the vertical trajectory of the ball.

Similarly, the vertical axis (y,y') perpendicular to axis (x,x') defines the angle of the surface and the lateral trajectory of the ball. A distribution of additional mass on this axis along either side of axis (y,y') directly influences the tolerance with respect to the lateral trajectory of the ball.

In order to arrive at an optimum tolerance, the mass will thus preferably be distributed homogeneously and continuously along the circumference of the impact surface 3. This distribution advantageously compensates for the loss of mass owing to this type of design, compared to a "wood-metal" type of construction which has an impact surface made of high density material. Therefore, the difference in mass is best utilized in such regions as defined previously.

Figure 5:
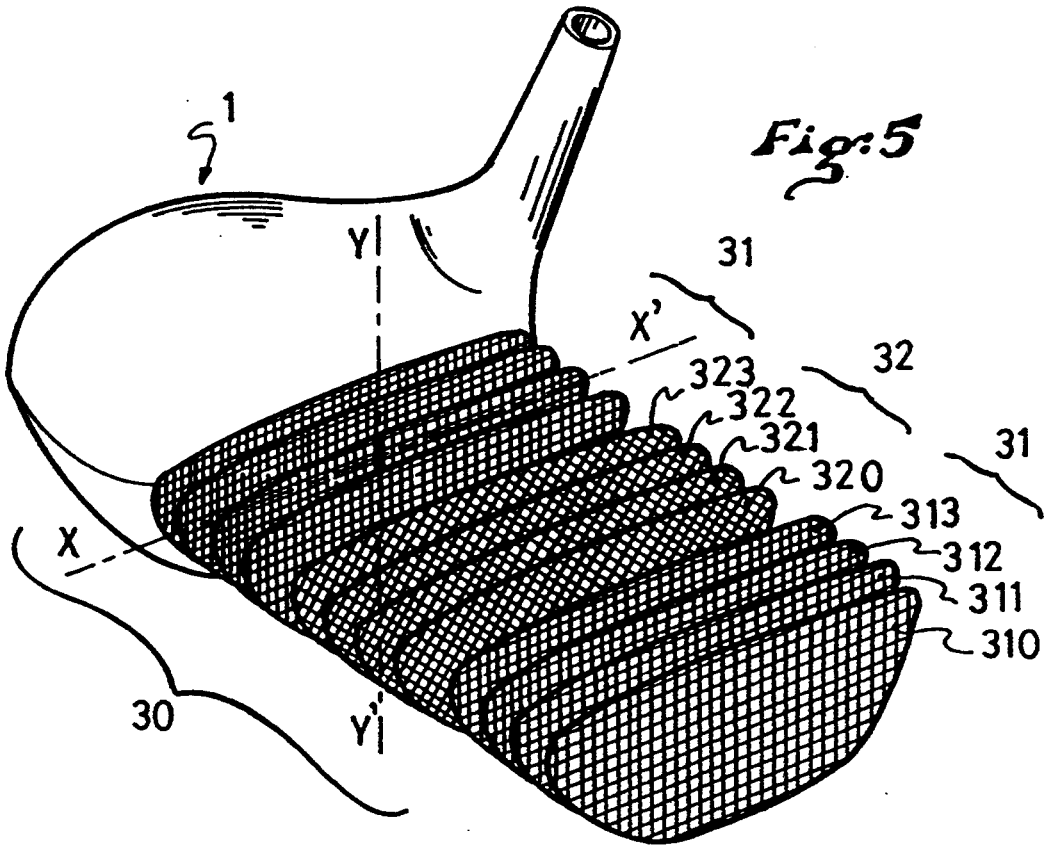
FIG. 5 is a perspective and exploded view of the head of FIG. 1.

The wall 30 is preferably constituted by stacking several woven webs of fiber. The particular orientation of the fibers constituting each woven web is represented in the example of FIG. 5. In this case, the wall includes first webs 31, 310, 311, 312, 313 the fibers of which are oriented along the axis (x,x') on the one hand, and along the axis (y,y') on the other hand. The wall also includes second webs 32, 320, 321, 322, 323 oriented at +45° and −45° out of phase with respect to the axis (x,x'). Preferably, the wall comprises a successive stacking of 10 to 25 fiber webs 31, 32.

Figure 5A:
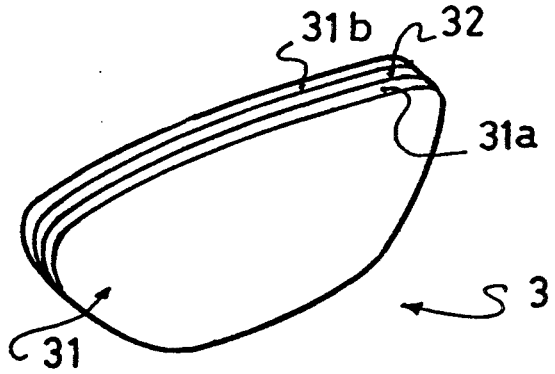
FIG. 5*a* is a perspective view of a detail of FIG. 5.
Figure 5B:
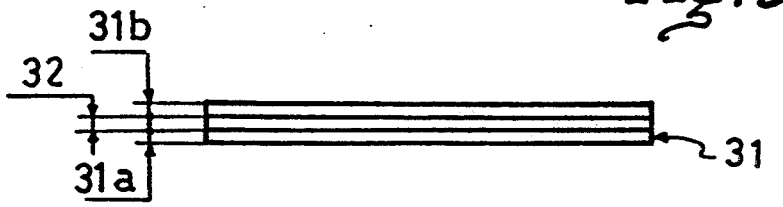
FIG. 5*b* is a top plan view of the detail of FIG. 5*a;*

In order to optimize the resistance of the wall 30, a particularly advantageous sequence of the first 31 and second 32 webs has been devised according to an embodiment represented in FIGS. 5*a* and 5*b*. Therefore, the wall comprises a sequence of a first external layer 31*a* of first webs 31 whose fibers are oriented along axes (x,x') and (y,y') of a second intermediary layer of second webs 32 whose fibers are oriented at +45° and −45° of axis (x,x'), and a third internal layer 31*b* of first webs 31 with the fibers oriented along the axes (x,x') and (y,y'). The second intermediary layer includes approximately between 3 and 9 webs.

The first external layer 31*a* is intended to resist the compressive forces from the shock of the ball and the third internal layer 31*b* is intended to resist tractional forces. The forces are mainly oriented along the axes (x,x') and (y,y'). The second intermediary layer 32 is intended to resist shearing forces at the neutral fiber level, mainly oriented at +45° and −45° with respect to axis (x,x').

An example of the construction of a resistant wall 30 made of a composite material and its mechanical characteristics can be provided.

The wall is constituted by a balanced stack of woven webs of carbon fiber and epoxy resin. The volume ratio of fibers/resin is equal to 1. The thickness of a web equals 0.2 mm. The fibers have a modulus of elasticity equal to 230 GPa and a tear resistance equal to 4410 MPa (fiber of the T300J type by TORAY ®).

The stack is constituted by a first external layer 31*a* of 6 woven webs of fiber oriented along axes (x,x') and (y,y') (known as orientation "0°, 90°"); a second intermediary layer 32 of 5 woven webs of fiber oriented at +45°, −45° with respect to axis (x,x'), and a third internal layer 31*b* of 6 woven webs of fiber oriented at 0°, 90°.

The wall 30 has a modulus of elasticity along axis (x,x') or axis (y,y') equal to 60 GPa, and a tear resistance of 500 MPa.

One can likewise specify that a construction comprising a second intermediary layer of only 3 or fewer webs of fiber at the neutral fiber level does not resist sufficiently to the shock from the ball and leads to a rupture of the wall 30. This rupture phenomenon is also noted in a construction comprising a second intermediary layer of 9 or more woven fiber webs at +45°, −45° as a partial substitute of the woven fiber webs at 0°, 90°.

FIG. 6 illustrates a variation of the invention in which the internal cavity 5 is limited entirely by the shell 6, especially by the lower 60, rear 61, and front 63 walls. In other words, the shell 6 forms a closed hollow body. In this case, the impact surface 3 is constituted by an attached plate made of a composite material and is affixed to the external surface of the front wall 63 of shell 6.

In this case, and contrary to the embodiments described previously, the shell 6 and specifically its front wall 63 participates in the mechanical resistance and rigidity of the impact surface. But in addition, the front wall 63 acts as an adhesive support for the impact surface 3. The thickness e1 of the front wall 63 can be comprised between approximately 1.0 and 3.5 mm. The thickness e2 of the attached composite plate can comprise approximately between 1.0 and 5.0 mm. Finally, to avoid an oversizing giving rise to an excessive rigidity of the impact surface, the total thickness e, equal to the sum of e1 and e2, must not be greater than approximately 7.0 mm in the case where e2 is between 3.0 and 5.0 mm only, and e must not be greater then 5.5 mm in the case where e2 is between 1.0 and 2.0 mm only.

Figure 7:
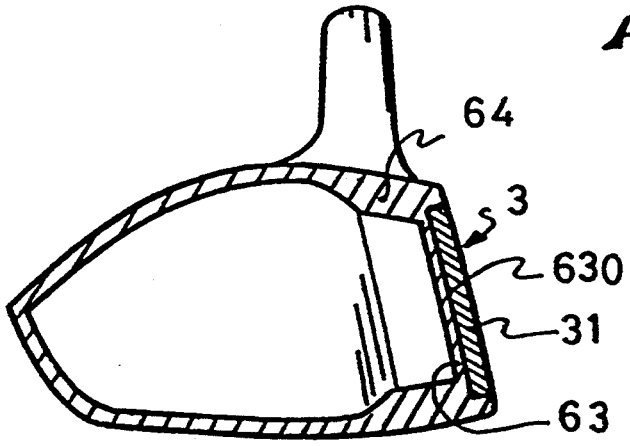
FIG. 7 is another variation.
Figure 8:
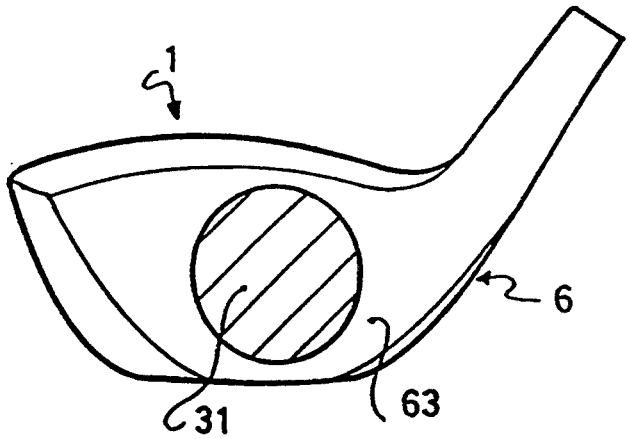
FIG. 8 is a front elevation view of FIG. 7.
Figure 9:
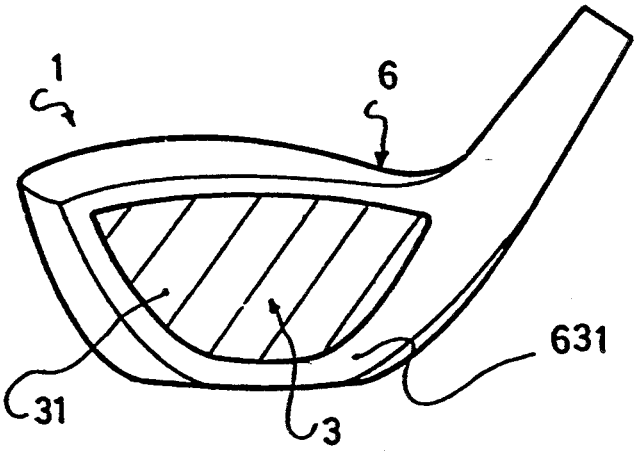
FIG. 9 is a variation of FIG. 7.

FIG. 7 illustrates another variation in which the impact surface 3 comprises a composite insert 31 filling a hollow/recess 630 obtained on the external surface of the front wall 63 of shell 6. This insert 31 extends at least into the impact zone of the surface, i.e., into a substantially circular zone of which the diameter is slightly greater than the nominal diameter of a golf ball, as shown in FIG. 8, for example. Of course, insert 31 can extend more broadly along either side of this zone as is represented in the embodiment of FIG. 9. In the latter case, the external flanks 631 bordering the hollow/recess 630 have a substantially constant width along the circumference of the impact surface.

Figure 10:
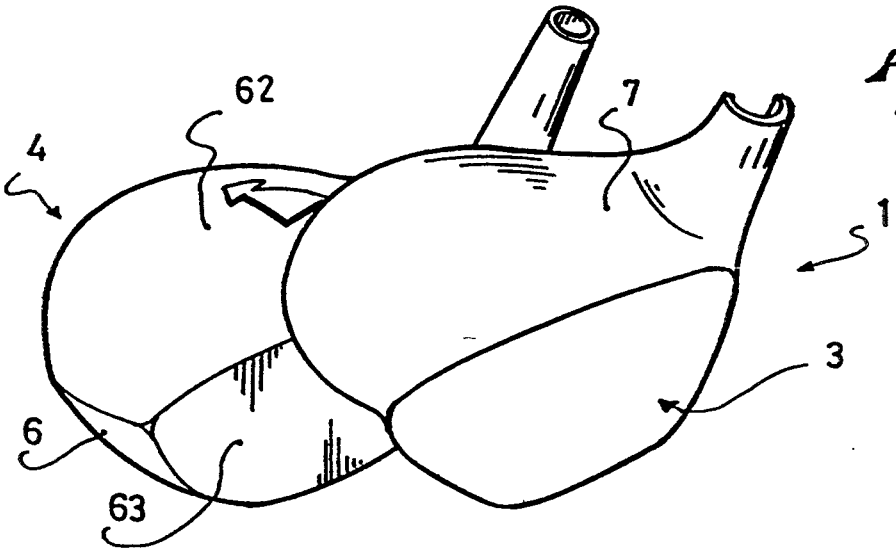
FIG. 10 is a perspective and exploded view of a variation of FIG. 1.
Figure 11:
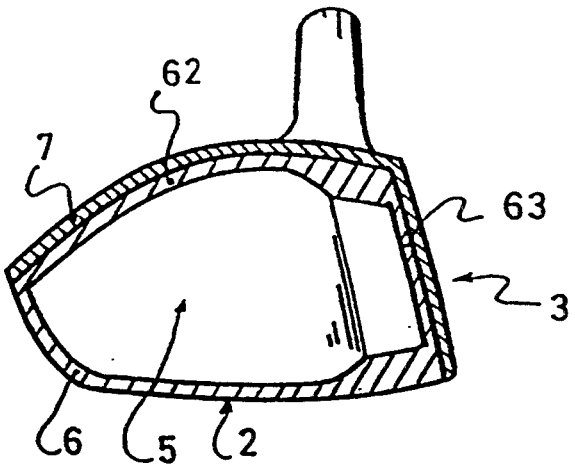
FIG. 11 is a sectional view taken along I—I' of FIG. 10.

FIGS. 10 and 11 represent a club head of the invention with the peculiarity that the upper 62 and front 63 wall is covered by an envelope 7 of composite material. In other words, the composite layer constituting the impact surface 3 extends beyond in a continuous and homogeneous fashion, to partially cover the shell. The envelope 7 and the impact surface 3 together form a continuous layer of material of an identical nature. The main advantage of this construction is that it substantially rigidifies the body 4 of the head 1, thereby enabling softer metals to be used for the production of the shell 6. In addition, the metallic sole provides the head with a durability that is greater than that of heads obtained entirely in composite material. The envelope 7 can be obtained by draping layers of materials made from long fibers preimpregnated with a thermohardenable matrix, for example. But one can also provide to proceed by injection of a thermoplastic resin loaded with short fibers, for example.

Figure 12:
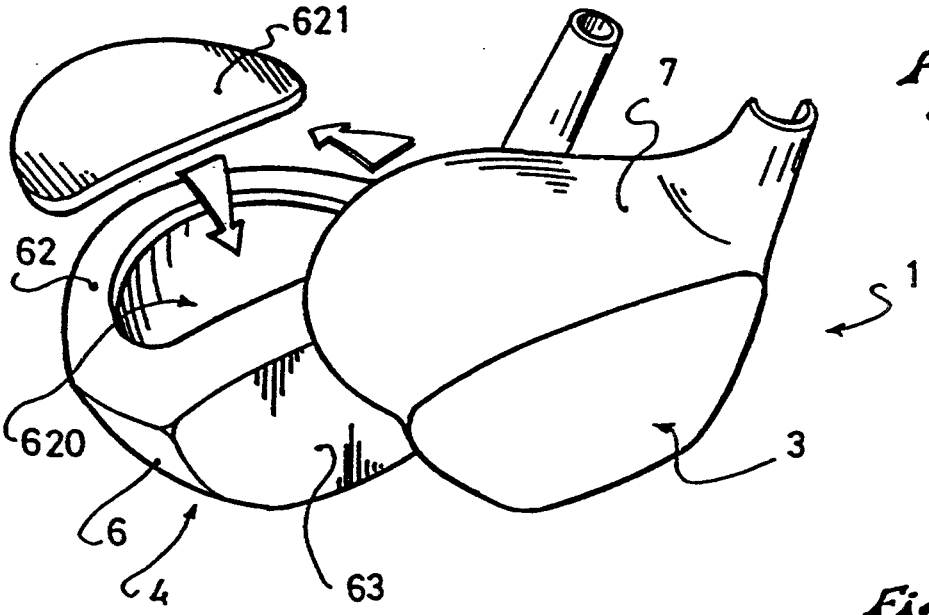
FIG. 12 is a perspective and exploded view of a variation of FIG. 10.
Figure 13:
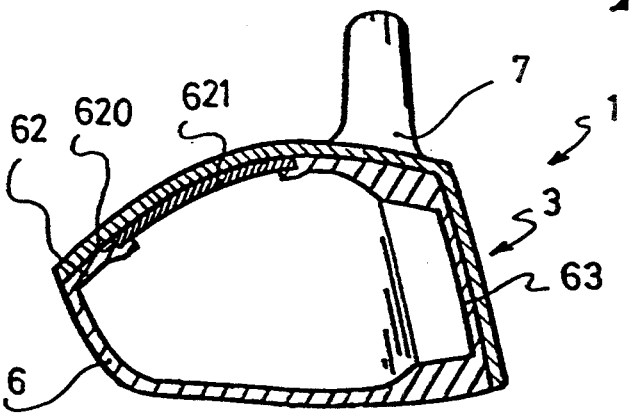
FIG. 13, is a sectional view along I—I' of the head of FIG. 12.

FIGS. 12 and 13 show a variation of FIGS. 10 and 11 in which the upper wall 62 of the shell 6 comprises an opening 620 closed by a plate 621 made of low density material comprised between 1 and 2, such as thermoplastic material, for example. The envelope 7 covers the upper wall 62 and especially the plate 621 as well as the front wall 63. This particular construction has the advantage of enabling an up to 15% to 20% concentration of mass in the locations as previously defined. Furthermore, the production of the shell in one piece is obtainable by conventional known molding methods, whereas in the case of FIGS. 10 and 11, the sole or lower wall 60 must be obtained separately and then assembled and welded to the shell 6.

Figure 14:
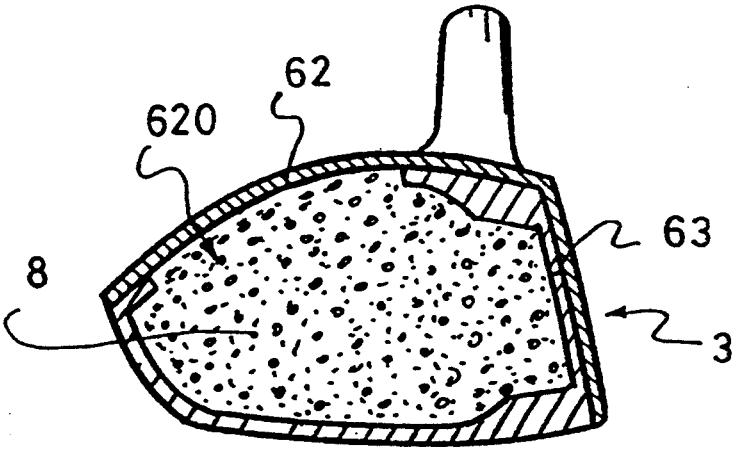
FIG. 14, is a sectional view along I—I' of a variation of FIG. 13.

FIG. 14 is a variation of FIGS. 12 and 13 in which the opening 620 of the shell is not covered by a support plate. In this case, in order to enable covering of envelope 7 of the upper wall 62 of shell 6, the internal cavity 5 and the opening 620 of the shell are filled with a light polyurethane foam, for example.

Figure 15:
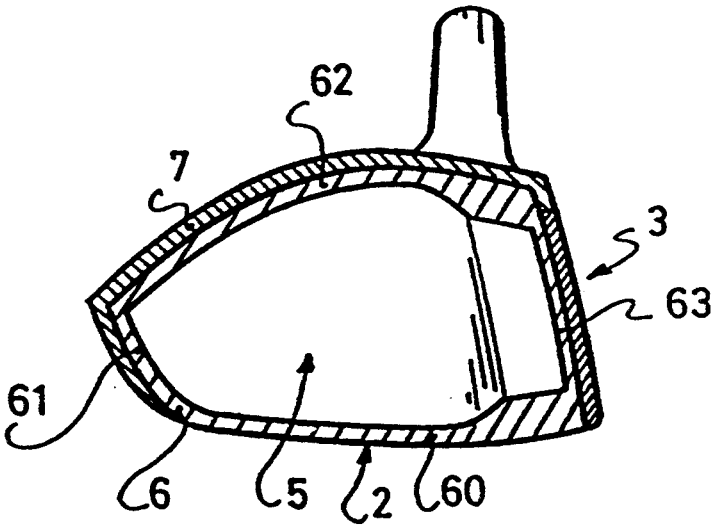
Figure 16:
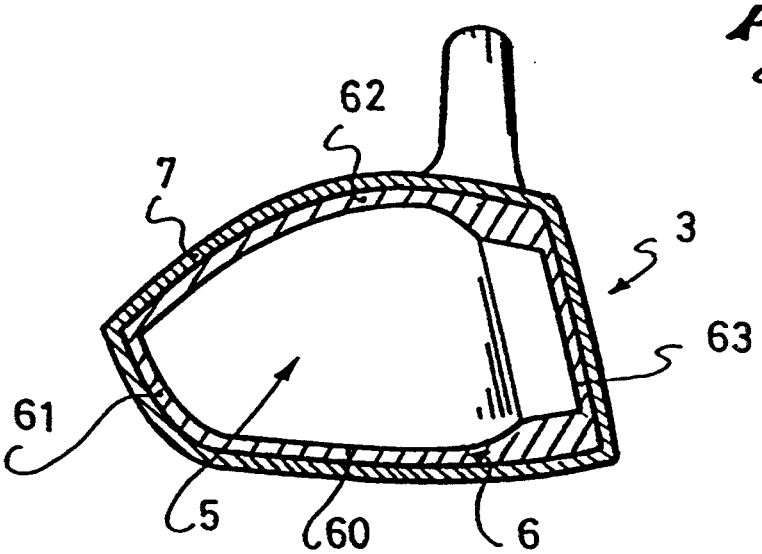

FIG. 15 is a variation of FIG. 11, in which the envelope 7 and the impact surface 3 are each constituted by a layer of composite material of a different and specific nature according to how they will be employed in the head. One can thus envision that the envelope 7 is constituted by a coating of preimpregnated non-woven webs of carbon or other fibers and of epoxy resin, and that the impact surface 3 is attached and constituted of woven webs of long carbon fibers and of a shock resistant matrix such as in (PPS), (PEI), (PEEK) or others.

In all the preceding examples, the sole 2 has been considered as constituting the lower wall 60 of the shell 6. But of course, it could be otherwise without departing from the spirit of the invention. Thus, one can imagine that the sole is an attached metallic or other piece.

It can also be provided that the envelope 7 completely coats the head 1 and covers all the walls 60, 61, 62, 63 of the steel shell 6 as is shown in FIG. 11. This embodiment has the advantage of rigidifying the head. During impact with the ball, the head is less deformed, resulting in less energy loss and consequently, a better yield of restituted energy is obtained.

Finally, the internal cavity 5 can be filled with a very low density polyurethane foam, for example, in each of the embodiments shown. In this case, the foam merely serves to advantageously modify the noise from the impact of the ball by imparting a lower sonority often preferred by the players.

Of course, the invention is not limited to the embodiments described and represented as examples but also comprises all technical equivalents and combinations thereof.

We claim:

1. A golf club head of the wood type, said golf club head comprising:
   - a shell comprising:
     - an outside lower portion intended to rest on the ground, constituting the sole of the club head;
     - a substantially planar front portion partially forming a wall of an impact surface of the club head; and
     - a rear portion constituting the body of the club head;
     - said lower portion, said front portion and said rear portion of said shell defining at least partially a closed internal cavity; and
   - a fiber-based composite material having a modulus of elasticity greater than or equal 230 GPa positioned at said wall of an impact surface, said fiber-based composite material comprising a ball impact zone.

2. A golf club head according to claim 1, wherein: said shell is made of steel.

3. A golf club head according to claim 2, wherein: said closed internal cavity is entirely limited by an upper portion of said shell and said lower portion, said front portion and said rear portion.

4. A golf club head according to claim 2, further comprising:
   - an envelope of composite material at least partially covering said rear portion of said shell, said shell forming a closed hollow body.

5. A golf club head according to claim 4, wherein: said envelope and said impact surface comprise a unitary layer of material having an identical nature.

6. A golf club head according to claim 4, wherein: said envelope and said impact surface comprise a layer of material having different natures.

7. A golf club head according to claim 2, wherein: said front portion of said shell comprises a forward facing recess and said fiber-based composite material comprises an insert positioned within said recess.

8. A golf club head according to claim 3, wherein:

said front portion of said shell comprises a forward facing recess and said fiber-based composite material comprises an insert positioned within said recess.

9. A golf club head according to claim 2, wherein:

said shell comprises an excessive thickness of material forming an additional mass of inertia in a region near and behind a periphery of said impact surface.

10. A golf club head according to claim 9, wherein:

said additional mass of inertia extends homogeneously and continuously around a periphery of said impact surface.

11. A golf club head according to claim 2, wherein:

said composite material comprises fibers impregnated with thermoplastic resin.

12. A golf club head according to claim 2, wherein:

said composite material comprises a stack of woven webs of carbon and/or aramide fibers impregnated with a thermohardenable resin material.

13. A golf club head according to claim 12, wherein:

said stack comprises a first plurality of woven webs of fibers oriented along predeterminate perpendicular axes (x,x') and (y,y') and a second plurality of woven webs oriented at +45° and −45° out of phase with respect to said axis (x,x').

14. A golf club head according to claim 12, wherein:

said fibers at least partially comprise long carbon fibers having a tear strength greater than or equal to 2450 MPa.

15. A golf club head according to claim 14, wherein:

said fibers at least partially comprise long carbon fibers having a tear strength greater than or equal to 2450 MPa.

* * * * *